US011820031B2

(12) United States Patent
Kanakaris et al.

(10) Patent No.: US 11,820,031 B2
(45) Date of Patent: Nov. 21, 2023

(54) SHAVING CARTRIDGES

(71) Applicant: BIC-VIOLEX SINGLE MEMBER S.A., Anixi (GR)

(72) Inventors: George Kanakaris, Anixi Attika (GR); Maria-Thiresia Zanidaki, Anixi Attika (GR); Nikos Skounakis, Anixi Attika (GR)

(73) Assignee: BIC VIOLEX SINGLE MEMBER S.A., Anixi (GR)

( * ) Notice: Subject to any disclaimer, the term of this patent is extended or adjusted under 35 U.S.C. 154(b) by 272 days.

(21) Appl. No.: 17/287,195

(22) PCT Filed: Oct. 25, 2019

(86) PCT No.: PCT/EP2019/079150
§ 371 (c)(1),
(2) Date: Apr. 21, 2021

(87) PCT Pub. No.: WO2020/089058
PCT Pub. Date: May 7, 2020

(65) Prior Publication Data

US 2021/0354320 A1 Nov. 18, 2021

(30) Foreign Application Priority Data

Oct. 31, 2018 (EP) ..... 18203775

(51) Int. Cl.
*B26B 21/22* (2006.01)

(52) U.S. Cl.
CPC ..... *B26B 21/222* (2013.01)

(58) Field of Classification Search
None
See application file for complete search history.

(56) References Cited

U.S. PATENT DOCUMENTS 6,671,961 B1 * 1/2004 Santhagens Van Eibergen ..... B26B 21/227 30/34.2
2004/0181943 A1 9/2004 Kwiecien
2005/0172494 A1 8/2005 Aviza et al.
(Continued)

FOREIGN PATENT DOCUMENTS

WO 01/39937 6/2001
WO 2004/007155 1/2004
WO 2016/010825 1/2016

OTHER PUBLICATIONS

International Search Report dated Jan. 7, 2020 in corresponding International PCT Patent Application PCT/EP2019/079150, 5 pgs.
(Continued)

*Primary Examiner* — Hwei-Siu C Payer
(74) *Attorney, Agent, or Firm* — Ruggiero, McAllister & McMahon LLC

(57) ABSTRACT

The disclosure relates to a shaving cartridge for a razor head, the shaving cartridge comprising one or more blades adapted to be secured within slots of a housing of the razor head, and a core matrix partially encasing the blades, the core matrix comprising a water-soluble material, wherein the core matrix is configured to hold the blades together before use thereby forming the shaving cartridge that is configured to be removably incorporated in the housing of the razor head.

15 Claims, 7 Drawing Sheets

(56) References Cited

U.S. PATENT DOCUMENTS

| | | | | |
|---|---|---|---|---|
| 2008/0216323 | A1* | 9/2008 | Guimont | B26B 21/44 30/526 |
| 2008/0256802 | A1* | 10/2008 | O'Connor | B26B 21/4012 30/50 |
| 2010/0122464 | A1 | 5/2010 | Ndou et al. | |
| 2012/0000074 | A1 | 1/2012 | Pazosschroeder | |
| 2014/0150264 | A1 | 6/2014 | Micinilio | |
| 2015/0107115 | A1 | 4/2015 | Al Ajmy | |
| 2021/0354320 | A1* | 11/2021 | Kanakaris | B26B 21/222 |

OTHER PUBLICATIONS

Extended European Search Report dated Mar. 1, 2018 in priority European Patent Application No. 18203775.4, 6 pgs.

* cited by examiner

SHAVING CARTRIDGES

CROSS REFERENCE TO RELATED APPLICATION(S)

This application is a National Stage Application of International Application No. PCT/EP2019/079150, filed on Oct. 25, 2019, now published as WO2020089058 and which claims priority from European Application No. EP18203775.4, filed on Oct. 31, 2018, the entire contents of which is incorporated herein by reference.

FIELD AND BACKGROUND OF THE DISCLOSURE

The present disclosure relates to a shaving cartridge.

It is known that the performance of a shaver depends on the blades and their lifetime. Considering that the blades are becoming dull after a few shaves, the blades are the components of a shaver that need to be replaced.

Traditionally, there are different types of shavers that users may select according to their requirements or preferences.

A first type, is a disposable shaver which is entirely thrown after usage. A shaver of this kind includes a razor head containing blades, where the head is fixed to a handle and is usually made with injected plastic, with blades fixed in the head. Disposable shavers are of low cost but generate a lot of waste.

Another type of shaver is a shaver with removable head. A shaver of this kind includes a permanent handle with a removable razor head which contains blades.

Traditionally the removable head is made of plastic with blades fixed in it, and sometimes with skincare products beside the blades in the form of strips.

There is less waste, but still the need of throwing the whole head. Furthermore, removable heads are very expensive for the customers and for the manufacturer too.

It has been consequently proposed shaver heads with a removable part basically comprising the blades, so that the rest of the shaver head does no longer need to be disposed of. However, it could be dangerous to engage the blades in the shaver head. Indeed, a user could easily injure his fingers when manipulating very sharp blades.

So, in this context, there is a need for less expensive shaver that is more efficient, more manageable and more ecological than shavers from the art and which prevents injury when blades manipulation is involved.

SUMMARY OF THE DISCLOSURE

According to a first aspect, the disclosure is about a shaving cartridge for a shaver head. The shaving cartridge comprises one or more blades adapted to be secured within slots of a housing of the razor head, and a core matrix partially encasing the blades. The core matrix comprises a water-soluble material. The core matrix is configured to hold the blades together before use thereby forming the shaving cartridge. The shaving cartridge is configured to be removably incorporated in the housing of the razor head.

According to this aspect, the core matrix permits the user to manipulate unused blades without any risk of injury while keeping them grouped. The core matrix also allows the user to maintain the razor head intact by removing only the used and dull blades from the razor head's housing. In other words, the shaving cartridge permits to keep the razor head, so it reduces waste and it offers the possibility to the user to have a premium shaver with a razor head of improved quality, such as a metal shaver razor head (for example). The encasing of the blades in the core matrix permits to protect the blades, to avoid injury at the time of placing new blades (shaving cartridge) on the razor head and to easily manipulate the shaving cartridge into the housing of the razor head. The core matrix comprises water-soluble materials, i.e. materials which can be dissolved in water before or during shaving. Encasing of the blades also guarantees alignment of the blades during replacement and during storage and transportation.

In embodiments, the blades may comprise a cutting edge which may be encased in the core matrix.

In some embodiments, the core matrix may be made of a mixture of powder and/or granules which may be compressed into a tablet-like form.

In some embodiments, the core matrix may be made of a mixture of a liquid mass which may form a solid shell or a solid tablet after cooling.

In some embodiments, the water-soluble material of the core matrix may form a block partially encasing and holding the blades. The block shape of the shaving cartridges contributes to facilitate their storage, e.g. in a case with other shaving cartridges. In embodiments, the case may comprise a box or separating foil for each separate shaving cartridge.

In some embodiments, the water-soluble material of the core matrix may be an adhesive. In further embodiments, the core matrix may comprise one or more layers made of water-soluble material, water-insoluble material or combinations thereof.

According to another aspect, the disclosure is about a razor head comprising a housing and a shaving cartridge substantially according to the disclosure, wherein the shaving cartridge is configured to be removably incorporated in the housing of the razor head.

In some embodiments, the housing may comprise one or more slots, each slot may be configured to receive one blade.

In some embodiments, the blades may be restrained and securely maintained in the slots of the housing via retaining elements. In embodiments the retaining elements may comprise sliding retaining elements allowing engagement and/or disengagement of the shaving cartridge with the housing.

In some embodiments, the shaving cartridge may comprise two or more blades arranged distanced apart in the core matrix. In these embodiments, the distances between the blades in the core matrix may correspond to distances between the slots of the housing of the razor head. An aspect of arranging the blades distanced apart in the core matrix is that the shaving cartridge may be customized to fit in different razor heads, depending on the separating distances of the slots of the razor heads.

In some embodiments, the housing of the razor head may comprise a safety element for locking the shaving cartridge within the housing and/or a blade removal element.

According to another aspect, the disclosure is about a shaver comprising the razor head according to the disclosure and a handle.

In some embodiments, the razor head of the shaver may be monolithically formed with the handle. In others, it may be releasably connected to a handle.

According to another aspect, the disclosure is about a process for realizing a shaving cartridge substantially as disclosed herein. The process comprises at least:

arranging two or more blades in a mold with a distance therebetween such that the blades are covered at least in part by the mold, providing a water-soluble mixture for depositing the mixture on and around the blades and constructing the core matrix.

BRIEF DESCRIPTION OF THE FIGURES

Particular non-limiting embodiments of the present disclosure will be described in the following with reference to the appended figures, in which.

DETAILED DESCRIPTION OF EMBODIMENTS OF THE DISCLOSURE

Shaving Cartridge

Figure 1:
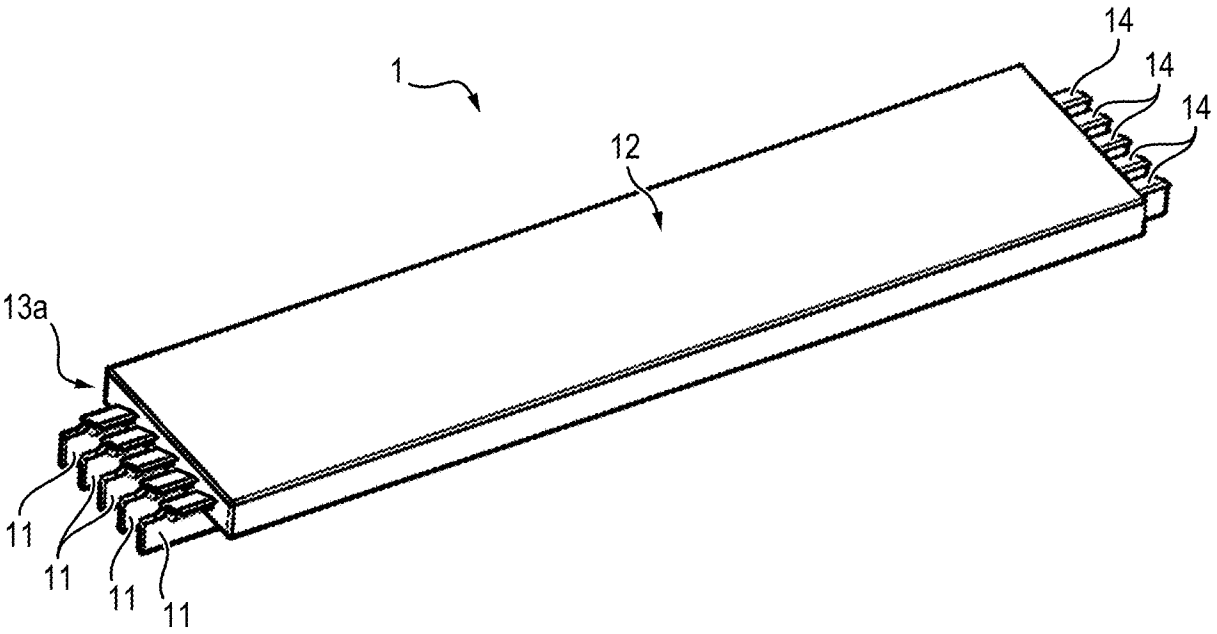
FIG. 1 is a perspective view of one embodiment of a shaving cartridge.

FIG. 1 shows a shaving cartridge 1 for a razor head 10. The razor head 10 may be part of a shaver which may also comprises a handle.

Figure 2:
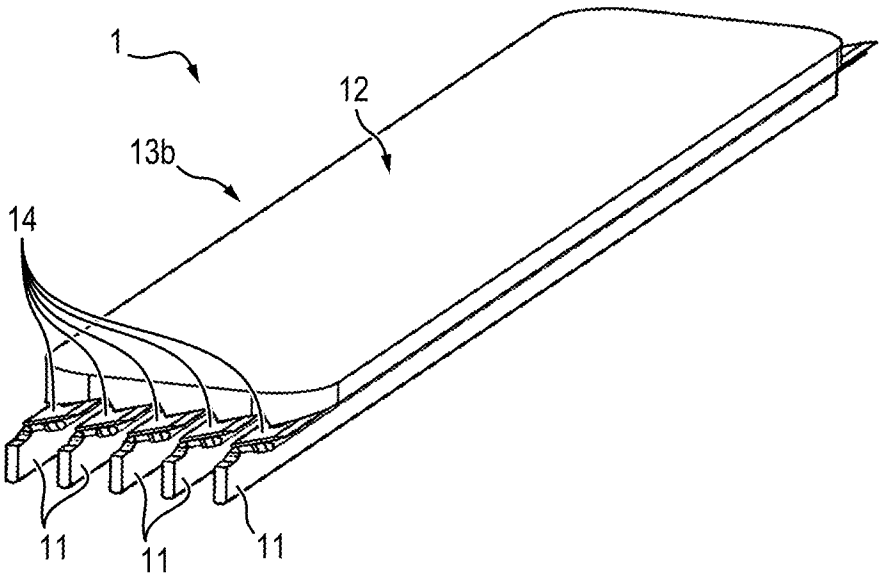
FIG. 2 is a perspective view of another embodiment of a shaving cartridge.

The shaving cartridge 1 may comprise several blades 11 held together, particularly in the embodiment of FIG. 1 and FIG. 2 five blades are shown. Other number of blades may be foreseen in further embodiments. The blades are arranged distanced apart from each other and are secured and held together by a core matrix 13*a*, 13*b* that partially encases the blades 11. The core matrix 13*a*, 13*b* comprises a water-soluble material. The core matrix 13*a*, 13*b* is configured to hold the blades together before use thereby forming the shaving cartridge 1. This way, the shaving cartridge 1 is configured to be removably incorporated in the housing 101 of the razor head 10 that will be described below regarding FIG. 3-7.

In the context of the present disclosure, "core matrix" should be understood as a structure that is tangible by the user and able to hold the blades together, so as for the user to be able to handle the blades as a unit, i.e. the shaving cartridge and the user is further able to e.g. incorporate the blades as a unit (shaving cartridge) into the housing of the razor head.

In the context of the present disclosure, the expression "water-soluble" in reference to the material of the matrix encasing the blade(s) means that a material contained in the matrix can, upon contact with water, at least be partially solubilized, dissolved or disintegrated in the water, thereby releasing the blade(s). In embodiments, of FIG. 1 the core matrix 13*a* may thus be made of material(s) completely soluble in water and thus may be fully dissolved in the water leading to an homogeneous solution of the components of the matrix in solution in water. In other embodiments of FIG. 2, the core matrix 13*b* may contain material(s) partially soluble in water and thus may be partially dissolved in the water and not fully removed through dissolution. Such an embodiment may be a core matrix 13*b* comprising a water-soluble material as adhesive, which may not be fully dissolved in the water, but it becomes less stiff after contact with water facilitating thus the manual removal of the matrix. Since water solubility may be dependent on temperature, the notion of water-soluble encompasses solubility at temperatures suitable for the use of the shaver of the disclosure. This may include regular cold or hot tap water. The expression "water-soluble" may also refer to situations where the matrix is made of materials that are only partially soluble and only one portion of the matrix can dissolve in water, the remaining being non-water soluble. In such a case, the solubilization of the water-soluble part of the core matrix 13*a*, 13*b* triggers the breakdown of the matrix leading to the release of the blade(s) or at least the release of the blade's cutting edge portion. Eventually, the component of the core matrix 13*b* may be only water-dispersible, meaning that the material of the core matrix—while not fully water soluble—may, upon contact with water, disintegrate, collapse, crumble or disaggregate, thus leading to an heterogeneous solution of more or less fine particles in suspension in water and also exposing as well the blade(s) that was(were) encased in the matrix.

As it will be detailed after, the shaving cartridge 1 may be stored in a case (not shown) with other shaving cartridges 1.

The blades 11 may comprise a cutting edge 14 which is also at least partially encased in the core matrix 13*a*, 13*b*. In embodiments, the non-cutting edges, e.g. at the bottom end of the blades 11 may be left free for attachment with the housing 101 of the razor head 10. The encasing of the cutting edges 14 permits to easily manipulate the shaving cartridge 1 without any risk of injury, as the cutting edges 14 cannot be reached or touched by the user at the time of mounting the shaving cartridge on the razor head. In embodiments, the core matrix 13*a*, 13*b* permits the user to change only blades 11 from the razor head 10, i.e. the core matrix 13*a*, 13*b* acts as a kind of holder or lever for gripping and manipulating the blades 11. Then, because of the water-solubility property of the material that the core matrix 13*a*, 13*b* comprises, the core matrix 13*a*, 13*b* dissolves when the user rinses the razor head 10, thereby exposing the cutting edges 14 and allowing use of the blades 11 for shaving.

In some embodiments, the water-soluble material of the core matrix 13*a*, 13*b* may form a solid block 12 partially encasing and holding the blades 11. More specifically, the block 12 may encase the cutting edges 14 of the blades 11. According to the embodiment of FIG. 1 the block 12 may have a rectangular shape. Other shapes such as e.g. cylindrical, elliptical, polygonal, may also be foreseen in more embodiments.

In other embodiments, as shown in FIG. 2 the water-soluble material of the core matrix 13*b* may be an adhesive and the core matrix 13*b* may further be configured in a film/sheet form having a thickness between 0.1-5 mm and comprising one or more layers made of water-soluble material, water-insoluble material or combinations thereof. The core matrix 13*b* being configured in film/sheet form may partially encases the blades 11 by being adhered onto the cutting edges portions 14 of the blades 11 by using the adhesive. The adhesive may be water-soluble, for example a water-soluble glue, such as a glue based on polyvinyl alcohol. More specifically, the core matrix 13*b* being configured in a film/sheet form may comprise a single layer made of water-soluble material. Example compositions for the construction of the water-soluble core matrix are described below. In some embodiments, the core matrix being configured in a film/sheet form may comprise a single layer made of water-insoluble material. Examples of water-insoluble materials may be high impact polystyrene, acrylonitrile-butadiene-styrene copolymer, ethylene vinyl acetal copolymer, styrene co-polymers, polyethylene, polypropylene, polyacetal, polylactic acid, polycarbonate, maleic anhydride ethylene co-polymer blends, polyether-containing block copolymers (e.g. with polyamide), thermoplastic elastomer compounds (TPEs) and mixtures thereof. In embodiments, the core matrix comprising a layer of water-insoluble material may also bear aesthetic configurations, such as logo or graphics. In some embodiments, the core matrix may be structured in a two-layer form comprising a top layer and a bottom layer. The top layer may be water-insoluble and the bottom layer may be water-soluble. The bottom layer may act as supporting portion, on the bottom of which the adhesive is applied in multiple spots or as a unique, adhesive coating/layer. This way, the bottom layer of the core matrix 13*b* may be kept attached to the cutting edge portion(s) 14 of the blade(s) 11 and encase them. The bottom layer of the core matrix 13*b* may maintain the blade(s) 11 in predetermined spacing, allowing the user to position within the slots of the housing the blade(s) 11 that was(were) encased in the core matrix 13*b*. The core matrix 13*b* being structured in a two-layer form facilitates the user to remove the core matrix 13*b* through rinsing with water. Particularly, the water may rapidly dissolve the water-soluble regions of the core matrix, because the water may come in contact with a larger area due to the expanded surface provided by the bottom layer of the core matrix and not only a thin surface or spots of adhesive. This way, the user may remove the core matrix so as to release the blades either by rinsing the matrix with water till complete dissolution of the adhesive and the water-soluble layer or by rinsing the matrix with water till partially dissolving the adhesive, loosening thus the attachment of the core matrix 13*b* onto the blades 11 and allowing manually detaching (peeling-off) of the core matrix.

In embodiments, the core matrix 13*a*, 13*b* may be made of a mixture of powder or granules or a mixture thereof which are compressed into a tablet-like form.

In embodiments, the water-soluble core material of the matrix 13*a*, 13*b* may be made of a mixture of a liquid mass which forms a solid shell or a solid tablet after cooling. The liquid mass, i.e. the mixture being in liquid state, comes as result from the heating/melting of the raw ingredients included in the mixture. Depending on the properties of the raw ingredients, the liquid state of the mixture may be achieved by applying different temperatures. For example, the mixture may be in liquid state after heating in temperatures of 50° C. or higher, and more specifically after heating in temperatures higher than 55° C. Alternatively, temperatures higher than 60° C. may also be applied. Subsequently, the mixture may be solid to form a solid shell or a solid tablet by being maintained in ambient temperature, for example about 20° C. In some embodiments, different temperatures may also be applied on the mixture to form a solid shell or solid tablet, depending on the properties of the raw ingredients included in the mixture.

According to a first embodiment about the water-soluble material that the core matrix may comprise, the core matrix may comprise 10-80% by weight diluents, 0.1-80% by weight binding agents, 1-10% by weight disintegrant, 0.2-10% by weight lubricant and 5-95% by weight filling agents.

According to this first embodiment, diluents may be selected among: lactose, starch, mannitol, sorbitol, dextrose, microcrystalline cellulose, dibasic calcium phosphate, sucrose-based diluents, confectioners sugar, monobasic calcium sulfate monohydrate, calcium sulfate dihydrate, calcium lactate trihydrate, dextrates, inositol, hydrolyzed cereal solids, amylose, powdered cellulose, calcium carbonate, glycine, or bentonite.

According to this first embodiment, binding agents may be selected among: gelatin, cellulose ethers, pectins, alginates (sodium alginate), polyvinyl pyrrolidone, lactose, microcrystalline cellulose.

According to this first embodiment, disintegrants may be selected among: alginates, starch (corn starch), pectins, carboxymethyl cellulose, ultramyl pectin, bentonite, polyvinyl polypyrrolidone.

According to this first embodiment, lubricants may be selected among: stearic acid, stearates, polyglycols, talcum, highly disperse silicon dioxide. In examples the lubricants may be stearates, more specifically magnesium stearate.

According to this first embodiment, filling agents may be selected among: starch, cellulose, lactose, saccharose, fructose, sorbitol, mannitol, calcium phosphate, calcium hydrogen phosphate.

According to a second embodiment about the water-soluble material that the core matrix may comprise 40-90% by weight diluents, 1-10% by weight binding agents, 2-15% by weight disintegrant, 0.2-2% by weight lubricant and 0.1-2% by weight glidant.

According to this second embodiment, diluents may be selected among: lactose, starch, mannitol, sorbitol, dextrose, microcrystalline cellulose, dibasic calcium phosphate, sucrose-based diluents, confectioners sugar, monobasic calcium sulfate monohydrate, calcium sulfate dihydrate, calcium lactate trihydrate, dextrates, inositol, hydrolyzed cereal solids, amylose, powdered cellulose, calcium carbonate, glycine, or bentonite.

According to this second embodiment, binding agents may be selected among: sucrose, lactose, starches, cellulose, modified cellulose such as microcrystalline cellulose and hydroxypropyl cellulose, xylitol, sorbitol, malitol, gelatin, polyvinylpyrrolidone, polyethylene glycol, PEG3350, PEG8000, xanthan gum and combinations.

According to this second embodiment, disintegrants may be selected among: agar, calcium carbonate, potato and tapioca starch, alginic acid, certain silicates, colloidal silicon dioxide, sodium starch glycolate, crospovidone (e.g. commercially available as Kollidon® CL-SF), crosslinked polyvinylpyrrolidone (e.g. commercially available as Kollidon® CL), povidone, sugar, sucrose, dextrose, mannitol and combinations According to this second embodiment, lubricants may be selected among: magnesium stearate, stearic acid, sodium stearyl fumarate, hydrogenated vegetable oil, talc, silica, mineral oil, glycerol monostearate, and combinations.

According to this second embodiment, glidants may be selected among: fumed silica, talc, magnesium carbonate, and combinations.

According to a third embodiment about the water-soluble material that the core matrix may comprise up to 65% of the total weight diluents, 0.1-10% by weight surfactants, and 1-45% by weight auxiliary agents.

In this third embodiment, auxiliary agents may be binders, disintegration agents, filling agents, stabilizers, lubricants, wetting agents, anti-adherents or glidants.

According to this third embodiment, diluents may be selected among: lactose, starch, mannitol, sorbitol, dextrose, microcrystalline cellulose, dibasic calcium phosphate, sucrose-based diluents, confectioners sugar, monobasic calcium sulfate monohydrate, calcium sulfate dihydrate, calcium lactate trihydrate, dextrates, inositol, hydrolyzed cereal solids, amylose, powdered cellulose, calcium carbonate, glycine, or bentonite.

According to this third embodiment, surfactants may be non-ionic hydrophilic surfactants and/or anionic hydrophilic surfactants: Non-ionic hydrophilic surfactants can be selected among: polyoxyethylene sorbitan esters, cremophores and poloxamers and mixtures. Anionic surfactants may be selected among: sodium lauryl sarcosinate, docusate and mixtures.

According to this third embodiment, as auxiliary agents, binders may be selected among: acacia, alginic acid and salts, cellulose derivatives, methylcellulose, hydroxyethyl cellulose, hydroxypropyl cellulose, magnesium aluminum silicate, polyethylene glycol, gums, polysaccharide acids, bentonites, hydroxypropyl methylcellulose, gelatin, polyvinylpyrrolidone, polyvinylpyrrolidone/vinyl acetate copolymer, crospovidone, povidone, polymethacrylates, hydroxypropylmethylcellulose, hydroxpropylcellulose, starch, pregelatinized starch, ethylcellulose, tragacanth, dextrin, microcrystalline cellulose, sucrose, or glucose.

According to this third embodiment, as auxiliary agents, disintegration agents may be selected among: starches, pregelatinized corn starch, pregelatinized starch, celluloses, cross-linked carboxymethylcellulose, crospovidone, cross-linked polyvinylpyrrolidone, a calcium or a sodium alginate complex, clays, alginates, gums, or sodium starch glycolate.

According to this third embodiment, as auxiliary agents, filling agents may be selected among: lactose, calcium carbonate, calcium phosphate, dibasic calcium phosphate, calcium sulfate, microcrystalline cellulose, cellulose powder, dextrose, dextrates, dextran, starches, pregelatinized starch, sucrose, xylitol, lactitol, mannitol, sorbitol, sodium chloride, polyethylene glycol.

According to this third embodiment, as auxiliary agents, stabilizers may be selected among: any antioxidation agents, buffers, or acids.

According to this third embodiment, as auxiliary agents, lubricants may be selected among: magnesium stearate, calcium hydroxide, talc, colloidal silicon dioxide, sodium stearyl fumarate, hydrogenated vegetable oil, stearic acid, glyceryl behenate, magnesium, calcium and sodium stearates, stearic acid, talc, waxes, stearowet, boric acid, sodium benzoate, sodium acetate, sodium chloride, DL-leucine, polyethylene glycols, sodium oleate, or sodium lauryl sulfate.

According to this third embodiment, as auxiliary agents, wetting agents may be selected among: oleic acid, glyceryl monostearate, sorbitan monooleate, sorbitan monolaurate, triethanolamine oleate, polyoxyethylene sorbitan monooleate, polyoxyethylene sorbitan monolaurate, sodium oleate, or sodium lauryl sulfate.

According to this third embodiment, as auxiliary agents, anti-adherents or glidants may be selected among: talc, corn starch, DL-leucine, sodium lauryl sulfate, and magnesium, calcium, or sodium stearates.

According to a fourth embodiment about the water-soluble material that the core matrix may comprise, when the core matrix is made from a mixture in liquid state, the core matrix may comprise 20-60% by weight structural ingredients as solid shell (when cooled) with increased solubility in water (preferably hot water), 10-35% by weight plasticizer and 15-50% by weight water. More specifically, the core matrix may contain 25-50% by weight structural ingredient as shell with increased solubility in water. Even more specifically, the core matrix may contain 40-50% by weight structural ingredient as shell with increased solubility in water. In embodiments, the core matrix may contain 10-25% by weight plasticizer. More specifically, the core matrix may contain 10-20% by weight plasticizer. In some embodiments, the core matrix may contain 25-40% by weight water. More specifically, the core matrix may contain 30-40% by weight water.

According to this fourth embodiment, structural ingredient as shell with increased solubility in water may be gelatin.

According to this fourth embodiment, plasticizer may be selected among: glycerin, sorbitan, sorbitol, or similar low molecular weight polyols.

According to a fifth embodiment about the water-soluble material that the core matrix may comprise, the core matrix may comprise 5-60% (more specifically 10-40%) by weight structural ingredients as film shell, 40-95% (more specifically 50-85%) by weight second film-forming polymer, 0.04-2% or 0.2-8% by weight setting system.

According to this fifth embodiment, structural ingredient as film shell may be pectin.

According to this fifth embodiment, secondary film-forming polymer may be selected among: gelatin, pullulan, polyvinyl alcohol, hydroxypropylated starch, hydroxyethylated starch, hydroxypropyl methylcellulose, hydroxypropyl cellulose, methylcellulose, hydroxyethyl cellulose, hydroxyethyl methyl cellulose.

According to this fifth embodiment, when the core matrix may contain 0.04-2% by weight setting system (to be combined with pectin), the setting system may be a salt comprising a divalent cation.

According to this fifth embodiment, when the core matrix may contain 0.2-8% by weight setting system (to be combined with pectin), the setting system may be polysaccharide such as carrageenan, gellan and mixtures.

Process for Realizing a Shaving Cartridge

Regarding the manufacturing process that can be applied for the construction of the shaving cartridge 1, where the core matrix is configured as solid block 12, the basic step may comprise the arrangement of the blades 11 in a die or a mold. In some embodiments, the blades 11 may be placed laterally into a jig according to a predetermined spacing and orientation. The jig may be a standalone component or part of a larger assembly that may have a recirculating function. The jig may come in contact with the non-cutting edges of the blades 11, at the bottom end of the blades 11, thus covering the bottom area of the blades 11 and/or side areas of the blades 11. The side areas of the blades 11 may act as holders to maintain the blades 11 in the jig. Then the jig may be placed between die components/compartments or in a mold. A further step may comprise providing a water-soluble mixture in the die components/compartments or the mold for depositing the mixture on and around the blades. Providing a water-soluble mixture may comprise flooding a liquid mixture or dispensing a powder/granules mixture. A liquid mixture for the core matrix may be inserted through one or more openings included in the die components/compartments or the mold. In these embodiments, even a single opening may suffice for the mixture to be injected through a nozzle. In some embodiments, the water-soluble mixture may be in the form of powder or granules. A powder/granules mixture may be already dispersed in at least one of the die components/compartments or the mold. The jig may be already configured to hold the blades 11 such that the cutting edges 14 may be able to contact the dispersed mixture. The jig may thus be inserted in a first die component/compartment including the mixture and a second, complementary die component/compartment may approach the first die component/compartment. Thus, constructing the core matrix is achieved by compressing the powder/granules mixture.

In other embodiments particularly for preparing a core matrix from a water-soluble mixture in liquid state, the blades 11 may be placed directly inside a mold upon insertion from an opening on the top, bottom or side surface of the mold according to predetermined spacing and orientation. The mold may be a standalone component or part of a larger assembly that may have a recirculating function. The mold may come in contact with the non-cutting edges of the blades 11, at the bottom end of the blades 11, thus covering the bottom area of the blades 11 and/or side areas of the blades 11. The side areas of the blades 11 may act as holdings to maintain the blades 11 in the mold. The opening in one of the surfaces of the mold may be sealed by another component that may also serve as a feeding point for the water-soluble mixture to be injected.

In these embodiments, constructing the core matrix 13*a*, 13*b* of the shaving cartridge 1 may comprise cooling (hardening) the liquid mixture, which includes the solidification of the water-soluble mixture till the mixture be solidified and be transformed to a stable core matrix 13*a*, 13*b* that captures and retains the blades 11 steadily and fixedly.

The core matrix 13*a*, 13*b* may be a compact composite. In case the core matrix 13*a*, 13*b* is a compact composite, the methods for deposition of the water-soluble mixture onto the blades 11 may vary depending on the state of the mixture. If the mixture is in form of granules or powder, the method applied for solidifying the core matrix 13*a*, 13*b* having the blades 11 embedded therein may be compression, substantially as described above. If the water-soluble mixture is in liquid state, the methods applied for solidification may be selected from the following processes: cooling of the mixture by feeding air stream or by placing it in a cooling chamber (e.g. refrigerator); heating of the mixture through passing hot air stream, or by applying heat from thermal resistors or from production ovens; heating through radiation (e.g. IR, laser, microwave) in case the mixture comprises ingredients that need curing so as to be solidified.

In further embodiments concerning a water-soluble mixture in liquid state, another approach for constructing the core matrix 13*a* of the shaving cartridge 1 may be based on the technology applied for the production of soft capsules. The core matrix 13*a* may comprise a solid shell, e.g. a gelatin or pectin shell, which may have the ability to capture (or encapsulate) several materials. The mixture for the shell may be heated so as to result in a molten liquid mass, which may be injected or poured into the mold with the blades 11 arranged, as long as it remains warm and liquid. The mixture may then be submitted to cooling in order to produce an one-piece core matrix 13*a* with a shell as outer layer of this composite that keeps the blades captured.

In the example shown in FIG. 1, the mixture of the core matrix 13*a* is in solid form, i.e. the water-soluble mixture is in powder or granules form that needs compression for the construction of a rigid matrix.

In other embodiments, where the core matrix 13*b* is configured in a film/sheet form, the applied manufacturing process depends on the structure of the core matrix 13*b* comprising a single layer made of a water-soluble mixture or a single layer of a water-insoluble material. The construction of a core matrix 13*b* comprising a single layer made of a water-soluble material may be based on treating a water-soluble mixture according to the manufacturing processes described above, but excluding the step about the arrangement of the blades in a die or a mold. In the embodiments that the core matrix may comprise a single layer of a water-insoluble material, the construction of the core matrix 13*b* may be based on extrusion or injection or lamination process. In the embodiments that the core matrix may be structured in a two-layer form comprising a top layer being water-insoluble and the bottom layer being water-soluble, each layer may be manufactured separately according to the previously mentioned processes. Constructing a core matrix in a two-layer form comprises the two layers to be kept attached by using an adhesive. The adhesive may be water-soluble allowing the top layer and the bottom layer of the core matrix to be maintained attached, till the user decides to rinse the matrix with water and leads the matrix to disintegration for releasing the blades.

Razor Head

Figure 3:
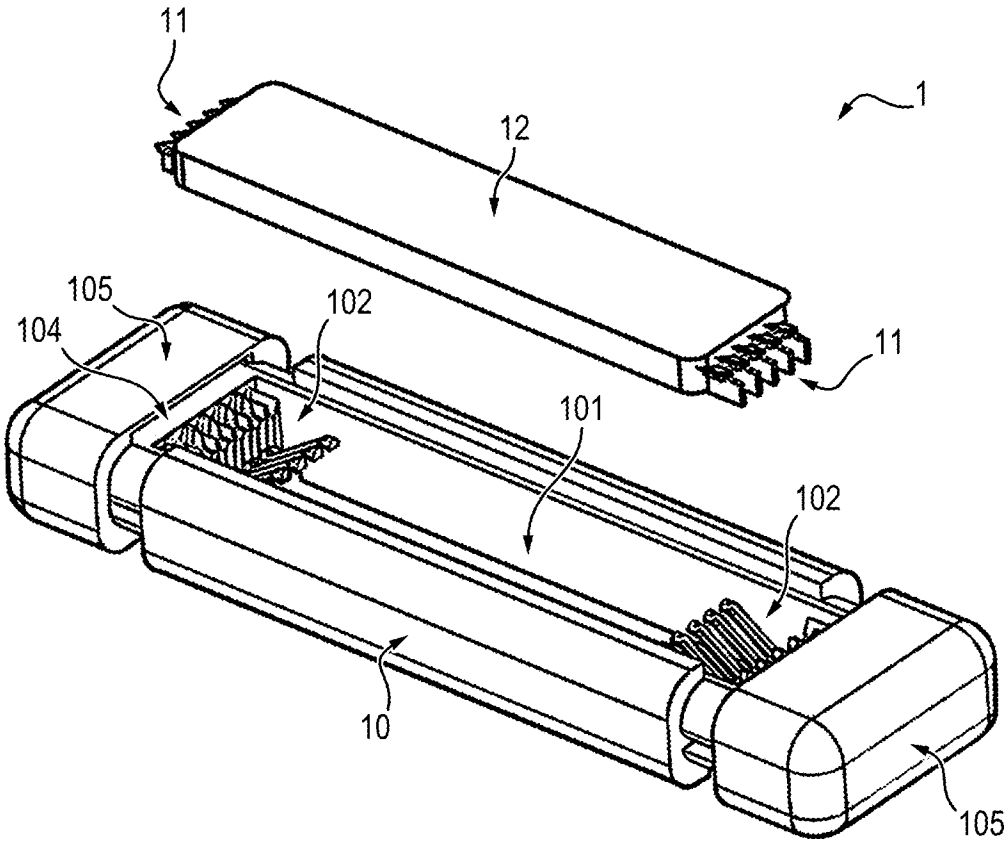
FIG. 3 is a perspective exploded view of a shaving cartridge of FIG. 1 and a razor head.
Figure 4:
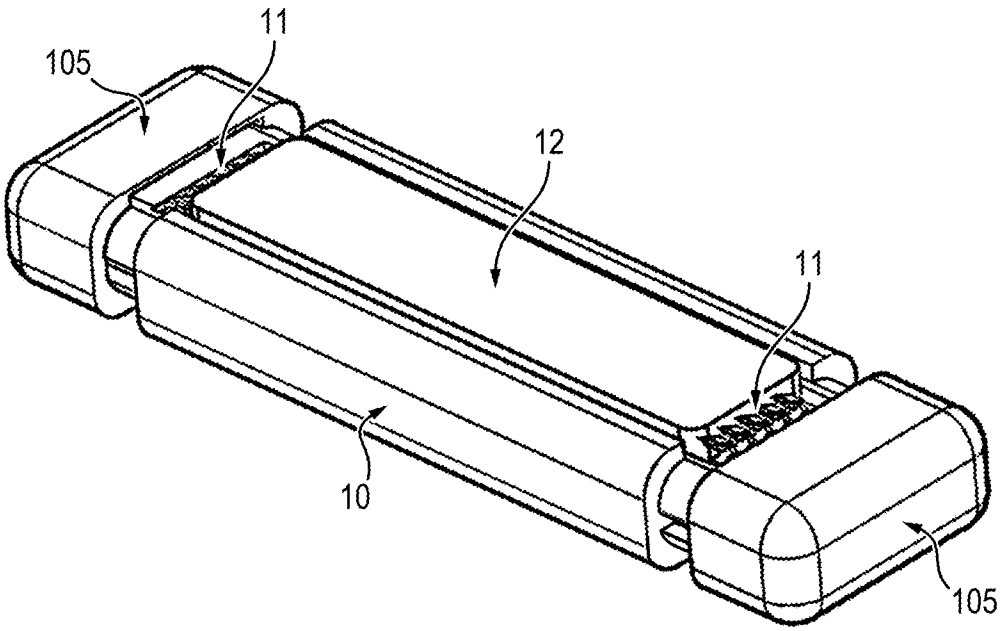
FIG. 4 is a perspective view of a shaving cartridge of FIG. 1 engaged in a razor head of FIG. 3.
Figure 5:
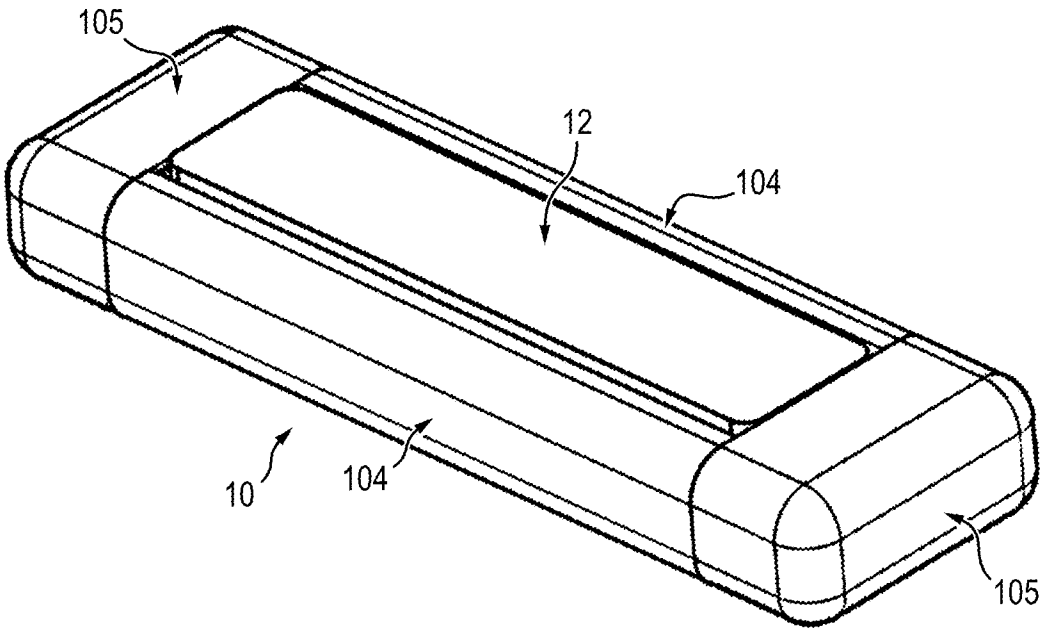
FIG. 5 is a perspective view of a shaving cartridge of FIG. 1 engaged and retained in a razor head of FIG. 3.
Figure 6:
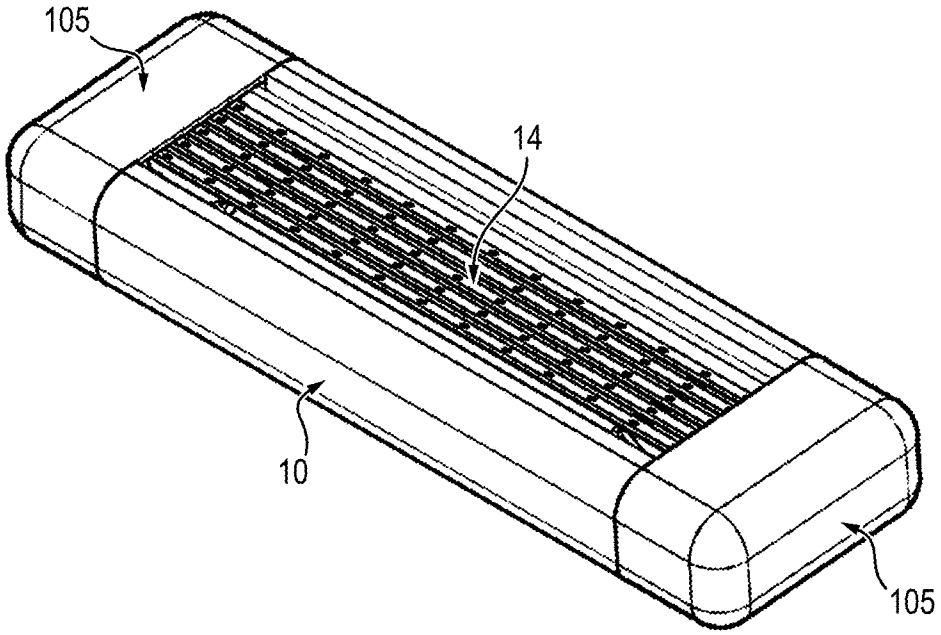
FIG. 6 is a perspective view of a shaving cartridge of FIG. 1 engaged and retained in a razor head of FIG. 3 after dissolution of the core matrix.

According to another aspect, as presented in FIG. 3-7, the disclosure is about a razor head 10 comprising a housing 101 and a shaving cartridge 1 substantially according to the disclosure. The shaving cartridge 1 is configured to be removably incorporated in the housing 101 of the razor head. The housing may comprise one or more slots 102. The example shown in FIG. 3 shows five slots but other number may be foreseen in further embodiments. The slots 102 adapted to receive a blade 11. In some embodiments and for movable blades, the slots 102 may comprise a resilient element (e.g. spring fingers) configured to provide a return force to the blade 11, when the blade 11 is under pressure due to contact with skin during shaving. The blades 11 may be restrained and securely maintained in the slots 102 within the housing 101 via retaining elements. More specifically sliding retaining elements 105, allowing engagement/disengagement of the shaving cartridge 1 to the housing 101 may be foreseen. In some embodiments, distances between blades 11 in the core matrix 13*a*, 13*b* may correspond to distances between the slots 102 so as to be able to secure all the blades 11 to the razor head 10 simultaneously. The retaining elements configured as sliding elements 105 permit to securely maintain the shaving cartridge 1 before shaving and they retain the blades 11 after removal of the core matrix 13*a*, 13*b*, e.g. after dissolution during shaving by a user. When a user decides to throw the blades 11, it is possible to eject the blades 11 away. The locking/unlocking mechanism involving sliding retaining elements allows the user to replace the blades 11 without touching them.

Figure 7:
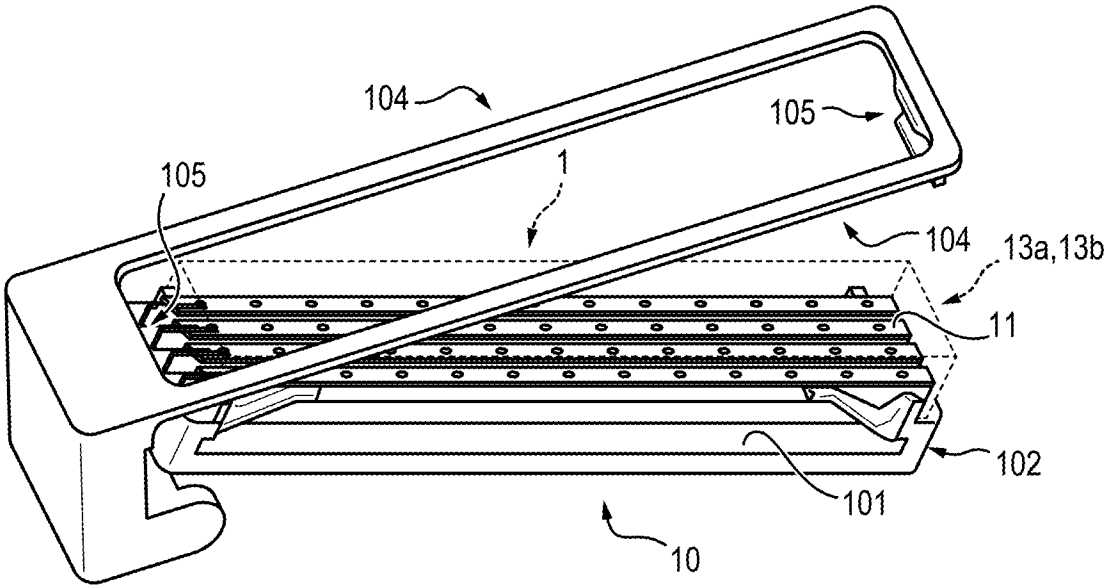
FIG. 7 is a perspective view of a shaving cartridge of FIG. 1 and an alternate embodiment of a razor head.

In alternative embodiments, the locking/unlocking mechanism may be based on a removable cover with a therethrough opening, as illustrated in the FIG. 7. The removable cover may secure the shaving cartridge 1 in place within the housing 101 through a snap lock attachment provided at one of side walls 104 the housing 101. The aperture allows exposure of the core matrix to the outside, for being removed upon rinsing with water and also allows exposure of the blade cutting edges during shaving. This one-side snap lock configuration allows the cover to be removably attached to the housing thereby permitting further replacement of the shaving cartridge 1 (or the blades 11).

The sliding retaining elements 105 for a razor head 10 may be designed with a kinematic functionality so as to allow the engagement/disengagement of the shaving cartridge 1. The sliding retaining elements 105 may be configured to lock the blades 11 in place when pushed inwards (slide in) or release the blades 11 when pulled outwards (slide out). The retaining elements 105 may have a substantially "C-shaped" configuration covering top and bottom surfaces of the side walls 104 of the housing 101, while engaging substantially the side surfaces of the side walls of the housing 101. In some embodiments, the retaining elements 105 may further engage the front and rear surfaces of the side walls of the housing 101. Thus, the retaining elements 105 can be easily gripped from the user and be slided inwards or outwards.

This way, when the blades of a shaving cartridge get dull, the user can thus slide outwards the sliding retaining elements, insert a new shaving cartridge into the housing of the razor head and slide back inwards the sliding elements for locking the new shaving cartridge.

The razor head 10 may further comprise a safety element (not shown) to prevent the undesirable or unintended unlocking of the shaving cartridge 1. In some embodiments, the safety element may be a release screw with a knob. In other embodiments, the safety element may be a snap-fit mechanism 105 (see FIG. 7).

Apart from the safety element, the housing 101 of the razor head 10 may also comprise a blade removal element (not shown). In some embodiments, the blade removal element may be a spring-loaded pushing element or a lever. This element may be part of the body of the housing 101 of the razor head 10 and its function may be to push the blades 11 outwards when the user wants to remove them. Thus, the user does not need to touch the blades that are in the housing. In some embodiments, the blade removal element may be housed in a region of the housing, inaccessible to the user during shaving. The substantially "C-shaped" configuration of the retaining elements may be used for this purpose. Moreover, the accessibility of the blade removal element by the user may be supported via the sliding functionality of the retaining elements. Particularly, the blade removal element formed as lever, for example, may be kept hidden/inaccessible at the inner, bottom surface of the retaining elements. When the retaining elements are slided inwards in locking position, the blade removal feature may be hidden at the interior of the retaining elements, e.g. at the inner, bottom surface of the retaining elements. When the retaining elements are in unlocking position (slided outwards) to leave the shaving cartridge exposed, the blade removal element emerges and is accessible by the user to set it in operation (e.g. to push it).

Shaver

According to another aspect, the disclosure is about a shaver (not shown) comprising a razor head 10 containing the shaving cartridge 1 and a handle (not shown). The razor head 10 may be releasably connected to the handle. The shaver head may be monolithically formed with the handle.

Although only a number of particular examples and embodiments have been disclosed herein, it will be understood by those skilled in the art that other alternative embodiments and/or uses as well as obvious modifications and equivalents thereof are also possible. Furthermore, the present disclosure covers all possible combinations of the particular embodiments and examples described. Reference signs related to drawings and placed in parentheses in a claim, are solely for attempting to increase the intelligibility of the claim, and shall not be construed as limiting the scope of the claim. Thus, the scope of the present disclosure should not be limited by particular embodiments or examples, but should be determined only by a fair reading of the claims that follow.

The invention claimed is:

1. A shaving cartridge for a razor head, the shaving cartridge comprising:

a. one or more blades adapted to be secured within slots of a housing of the razor head, and b. a core matrix partially encasing the blades, the core matrix comprising a water-soluble material, wherein the core matrix is configured to hold the blades together before use thereby forming the shaving cartridge that is configured to be removably incorporated in the housing of the razor head.

2. The shaving cartridge according to claim 1, wherein the blades comprise a cutting edge which is encased in the core matrix.

3. The shaving cartridge according to claim 1, wherein the core matrix is made of a mixture of powder and/or granules which are compressed into a tablet-like form.

4. The shaving cartridge according to claim 1, wherein the core matrix is made of a mixture of a liquid mass which forms a solid shell or a solid tablet after cooling.

5. The shaving cartridge according to claim 1, wherein the water-soluble material forms a solid block partially encasing and holding the one or more blades.

6. The shaving cartridge according to claim 1, wherein the water-soluble material is an adhesive and the core matrix further comprises one or more layers made of water-soluble material, water-insoluble material or combinations thereof.

7. A razor head comprising a housing and a shaving cartridge according to claim 1, wherein the shaving cartridge is configured to be removably incorporated in the housing of the razor head.

8. The razor head according to claim 7, wherein the housing comprises one or more slots, each slot adapted to receive one of the one or more blades of the shaving cartridge.

9. The razor head according to claim 8, wherein the one or more blades are restrained and securely maintained in the slots of the housing via sliding retaining elements.

10. The razor head according to claim 7, wherein the one or more blades comprises two or more blades arranged distanced apart in the core matrix, and wherein a distance between the blades corresponds to distances between the slots of the housing.

11. The razor head according to claim 7, wherein the housing comprises a safety element for locking the shaving cartridge within the housing.

12. A shaver comprising a razor head according to claim 7 and a handle.

13. The shaver according to claim 12, wherein the razor head is monolithically formed with the handle.

14. The shaver according to claim 12, wherein the razor head is releasably connected to the handle.

15. Process for realizing a shaving cartridge according to claim 1, the process comprises at least:

arranging two or more blades in a mold with a distance therebetween such that the blades are covered at least in part by the mold and providing a water-soluble material for depositing the material on and around the blades, wherein the water-soluble material constructs the core matrix.

* * * * *